US006511290B1

(12) United States Patent
Gatley, Jr.

(10) Patent No.: US 6,511,290 B1
(45) Date of Patent: Jan. 28, 2003

(54) BLOWER HOUSING WITH INTEGRAL EXHAUST FLANGE

(75) Inventor: William Stuart Gatley, Jr., Cassville, MO (US)

(73) Assignee: Jakel Incorporated, Highland, IL (US)

( * ) Notice: Subject to any disclaimer, the term of this patent is extended or adjusted under 35 U.S.C. 154(b) by 59 days.

(21) Appl. No.: 09/651,644

(22) Filed: Aug. 30, 2000

(51) Int. Cl.[7] ..... F01D 1/02

(52) U.S. Cl. ..... 415/212.1; 415/214.1; 285/322; 285/361; 403/265

(58) Field of Search ..... 415/212.1, 204, 415/206, 211.2, 214.1; 285/322, 323, 331, 361, 376, 377, 378, 379, 380, 381, 382, 383, 384, 385, 386, 387, 388, 389, 390, 391, 13, 14; 403/365, 367, 371, 373

(56) References Cited

U.S. PATENT DOCUMENTS 4,172,607 A * 10/1979 Norton ..... 285/236
4,293,149 A 10/1981 Bonel
4,416,474 A 11/1983 Miller et al.
4,674,262 A 6/1987 Goerlitz
4,958,857 A 9/1990 Sixsmith
5,158,328 A * 10/1992 Anderson et al. ..... 285/168
5,375,586 A 12/1994 Schumacher et al.
5,390,969 A 2/1995 Guest
5,415,825 A 5/1995 Sellers
5,431,456 A 7/1995 Okumura et al.
5,623,918 A 4/1997 Swilik, Jr. et al.
5,722,702 A * 3/1998 Washburn ..... 285/340
5,779,284 A 7/1998 Guest
5,853,198 A 12/1998 Richied et al.
5,911,155 A 6/1999 Webb
5,927,759 A * 7/1999 Hyslop ..... 285/9.1
6,029,505 A 2/2000 Webb

* cited by examiner

*Primary Examiner*—Edward K. Look
*Assistant Examiner*—James M McAleenan
(74) *Attorney, Agent, or Firm*—Thompson Coburn LLP

(57) ABSTRACT

A blower for a furnace is provided with an exhaust flange having a compressible end portion, and a flexible fitting adapted to receive an exhaust pipe is insertable into an interior of the exhaust flange. A clamp compresses the compressible end portion about the flexible fitting and the exhaust pipe to secure the exhaust pipe to the blower. A drain may be provided adjacent the compressible end portion to remove condensate which may be entrained in the exhaust gases from the exhaust pipe, exhaust fitting and exhaust flange.

17 Claims, 4 Drawing Sheets

BLOWER HOUSING WITH INTEGRAL EXHAUST FLANGE

BACKGROUND OF THE INVENTION (1) Field of the Invention

This invention relates to blowers used on high efficiency furnaces and, more particularly, to an exhaust interface formed on a discharge pipe of a blower housing.

(2) Background of the Invention

Blowers are commonly used in high efficiency furnaces (e.g. 90% efficiency) for drawing combustion air into the furnace and for removing exhaust gases from the furnace. Generally, these blowers are located downstream of a combustion chamber or combustion tubes in the furnace, depending upon the style of furnace, and propel exhaust gases out the furnace through an exhaust pipe that vents to outside atmosphere.

FIGS. 1 and 2 show the typical arrangement of a blower 20 of the prior art. The blower 20 includes a blower motor 22 and a blower housing 24. In FIG. 1A, the blower motor has been removed from its center mount 26 on top of the blower housing 24 to show greater detail of the blower housing 24. The blower housing 24 has an upstanding annular wall 28 extending between a top piece 30 and a bottom piece 32. The top piece 30 is molded to include the center mount recess 26 to receive the blower motor 22. The annular wall 28, top piece 30, and bottom piece 32 form a volute 34 for the blower housing 24. An impeller 22, operably connected to a shaft of the blower motor 22 rotates in the volute 34 when the blower 20 is energized to draw exhaust gases through an inlet hole (not shown) in the center of the bottom piece 32. The gases are then compressed in the volute 34 and directed into a discharge pipe 36 that extends outward and away from the volute 34.

FIG. 2 shows the general arrangement of the blower installed in a furnace 38. The blower is mounted on a blower mounting surface 40 on the furnace 38 where the inlet hole (not shown) of the blower housing 24 is positioned to allow the impeller to draw exhaust gases directly from the combustion chamber or combustion tubes (not shown) into the blower housing 24. The discharge pipe 36 is coupled to an exhaust pipe 42 using a double booted rubber gasket 46 to vent the exhaust gases to atmosphere. In the prior art, the blower housing 24 and exhaust pipe 42 are commonly made from a polypropylene or polyvinyl chloride (PVC) plastic material.

Greater detail of the double booted gasket 46 of the prior art is shown in FIG. 1B. The double booted rubber gasket 46 is a cylindrically shaped tubular member with first and second ends 48,50. The first end 48 has a first internal annular groove 52 that forms a first annular socket 54 that fits on a boss end 56 of the discharge pipe 36 of the blower housing 24. To secure the double booted rubber gasket 46 to the discharge pipe 36 of the blower housing 24, a first hose clamp 58 is typically used. The second end 50 of the double booted gasket 46 has a similar arrangement with a tubular insert 60 concentrically disposed within the gasket 46 to form a second internal annular groove 62. The exhaust pipe 42 is received within the second internal annular groove 62 and is secured to the double booted gasket 46 by tightening a second hose clamp 64. The second internal annular groove 62 has a groove root 66 with baffles 68 to collect condensate that is entrained in the exhaust gas stream. This condensate is collected at the root 66 and is removed from the double booted gasket 46 through drain portals 70 on the sides of the double booted gasket 46 that communicate with the groove root 66.

The use of the double booted gasket 46 has several drawbacks. The double booted gasket 46 is a complex part that must be manufactured in an intricate molding process. Because the gasket 46 is an added part to be fitted between the blower housing 24 and the exhaust pipe 42, it complicates the installation process. Further, as is readily apparent to those of skill in the art, a pair of pipe clamps must be aligned and screwed tight to complete the installation which takes some time and careful attention. The added part also increases the expense of the blower 20 and the installation of the blower 20 on the furnace 38.

The double booted gasket 46 must also be made from a relatively strong material that must withstand industry standards for mechanical strength and exhaust system integrity. Generally, in this application on a high efficiency furnace, the double booted gasket 46 must be able to maintain its connection to the discharge pipe 36 with a 25 ft-lb torque exerted on the exhaust pipe 42 (the "twist" condition). The gasket 46 must also maintain its connection to the discharge pipe 36 with a 50 lb. parallel pull out force exerted axially along the exhaust pipe 42 (the "pull-out" condition). Because the double booted gasket 46 has one hose clamp connection with the discharge pipe 36 and another hose clamp connection with the exhaust pipe 42, the double booted gasket 46 has two points for failure. Thus, the gasket 46 is susceptible to failure at either one of these two connections which represent the most likely point of failure.

What is needed in the art is a method of improving the connection between the blower housing 24 and the exhaust pipe 36 such that the industry standard mechanical tests for strength and exhaust system integrity are maintained while providing a less expensive part with an easier install procedure.

SUMMARY OF THE INVENTION

It is, therefore, an object of the present invention to provide an exhaust interface for a blower that simplifies the connection between the blower housing and the exhaust pipe while meeting the requisite industry standards for strength and exhaust system integrity.

The blower of the present invention includes a blower housing and a blower motor. The blower housing has an impeller and a discharge pipe for directing exhaust gases out and away from the blower. The discharge pipe has a first end that is formed adjacent the housing and an opposite second end that is spaced from the housing, or volute. The second end includes an exhaust flange with an annular socket and a plurality of resilient teeth extending axially outwardly from the second end and circumferentially spaced around the annular socket.

The blower includes an exhaust fitting that has an outer cylinder with a front end and an axially opposite back end, and a generally tubular insert disposed within the outer cylinder. An annular back wall extends between the outer cylinder and tubular insert. The tubular insert is attached to the annular back wall at the back end of the outer cylinder such that the tubular insert extends outward and away from the back wall and through the front end of the outer cylinder. The tubular insert forms an annular groove in the front end of the exhaust fitting.

The exhaust fitting is received in the annular socket of the exhaust flange, and the exhaust pipe is received in the annular groove. A clamping means such as preferably a pipe clamp for radially compressing the plurality of circumferentialy spaced teeth on the exhaust flange may be used to secure the exhaust pipe within the exhaust fitting and the exhaust fitting within the annular socket of the exhaust flange.

The exhaust fitting and exhaust flange are preferably keyed so that the exhaust fitting may be assembled in the annual socket on the exhaust flange in only one circumferential orientation. The exhaust flange preferably has an integral drain for removing condensate in the exhaust gases. In this configuration, the exhaust fitting may have a guttering system adjacent the back wall of the annular groove that directs condensate from the exhaust pipe into the drain on the exhaust flange. Preferably, each of the circumferentialy spaced teeth has a proximal end which is cantileverly attached to the second end of the discharge pipe and a distal end which is spaced away from the proximal end. The distal end of each of the teeth may have an annular ridge that extends radially outward and engages a portion of the clamping means to prevent the clamping means from sliding off the teeth when the clamping means is tightened around the teeth. The clamping means is preferably a pipe clamp, as in the prior art. The discharge pipe, exhaust flange, and volute of the blower housing are preferably monolithically constructed as the exhaust flange may be molded as a mold insert as the blower housing is molded.

BRIEF DESCRIPTION OF THE SEVERAL VIEW OF THE DRAWINGS

Further objects and features of the invention are revealed in the following detailed description of the preferred embodiment of the invention and in the drawings, wherein.

Corresponding reference characters indicate corresponding parts throughout the several views of the drawings.

DETAILED DESCRIPTION OF THE PREFERRED EMBODIMENTS

Figure 1A:
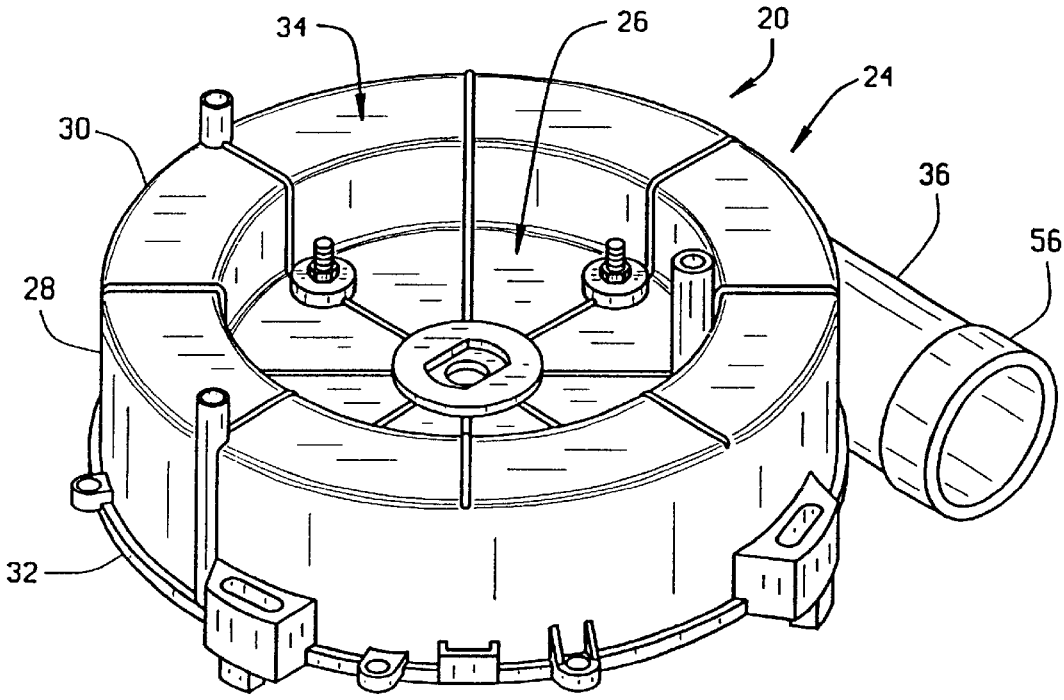
FIG. 1A PRIOR ART
FIG. 1A is a perspective view of a blower housing of the prior art.
Figure 1B:
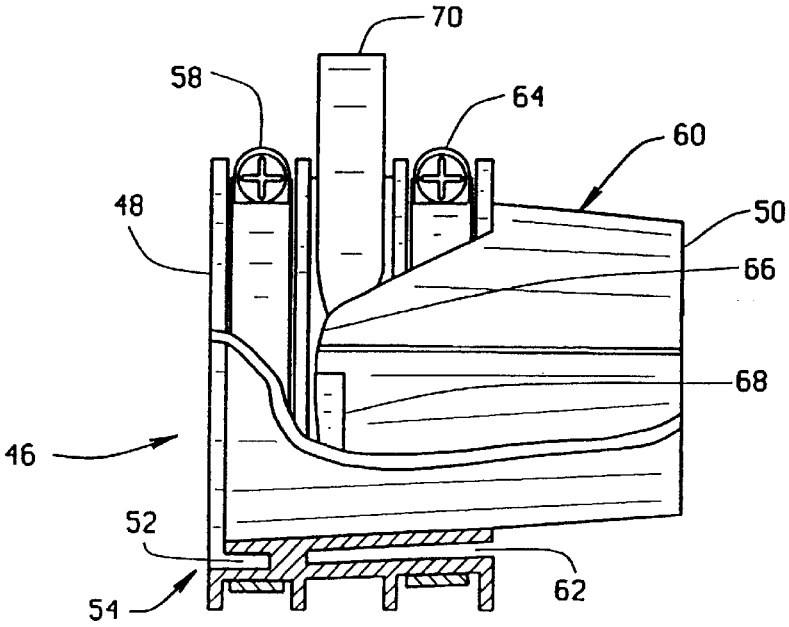
FIG. 1B PRIOR ART
FIG. 1B is a cross-sectional side view of a double booted gasket of the prior art.
Figure 2:
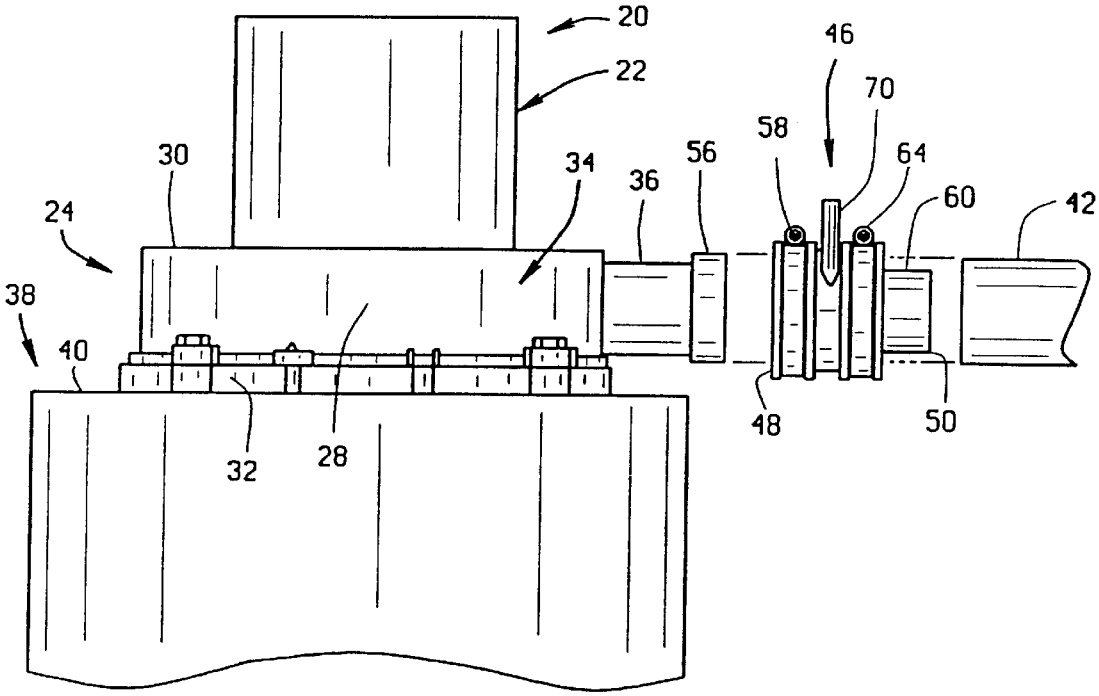
FIG. 2 PRIOR ART
FIG. 2 is an exploded view of the blower and double booted gasket of the prior art.
Figure 3:
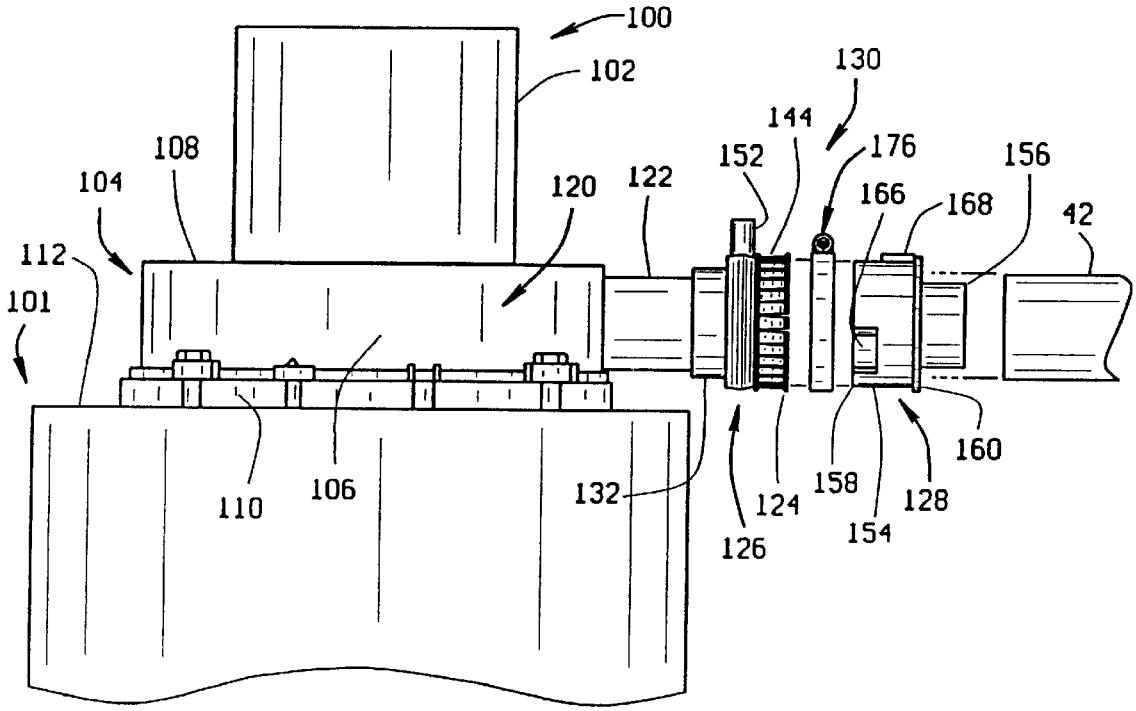
FIG. 3 is an exploded view of a blower of the present invention.

FIG. 3 shows a blower 100 of the present invention in its arrangement in a furnace 101. The blower 100 includes a blower motor 102 and a blower housing 104. The blower housing 104 has an annular upstanding wall 106 extending between a top piece 108 and bottom piece 110. The bottom piece 110 is mounted on a blower mounting surface 112 in the furnace 101, or the furnace bonnet, and has a center hole (not shown) through which exhaust gases are drawn into the blower housing 104.

Figure 4:
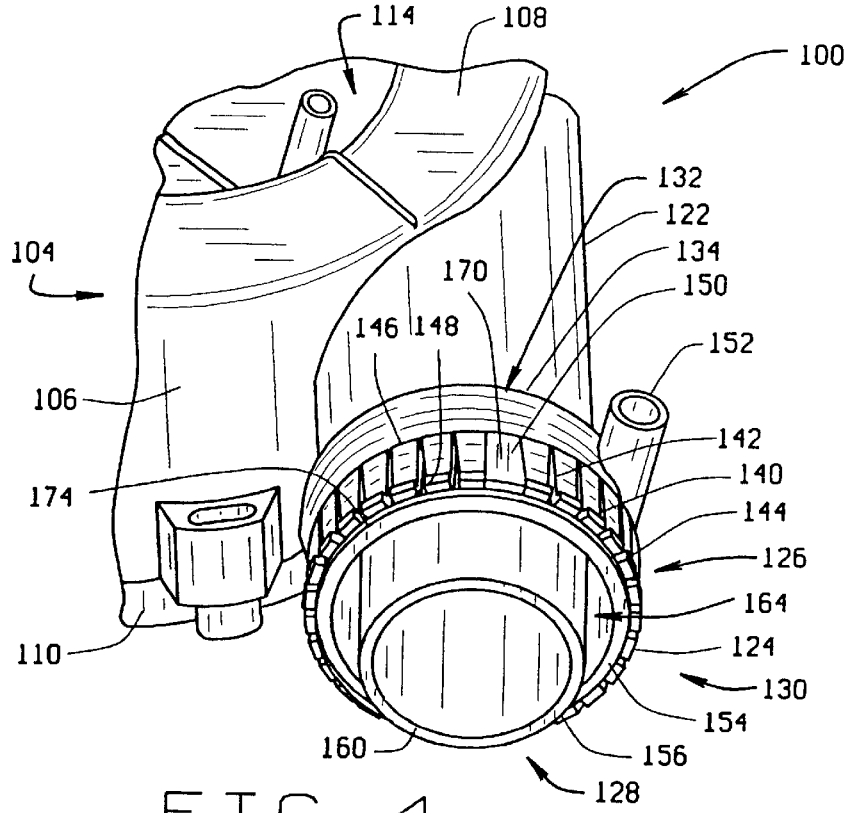
FIG. 4 is a partial, front, perspective view of an exhaust fitting inserted into the blower housing of FIG. 3.
Figure 5:
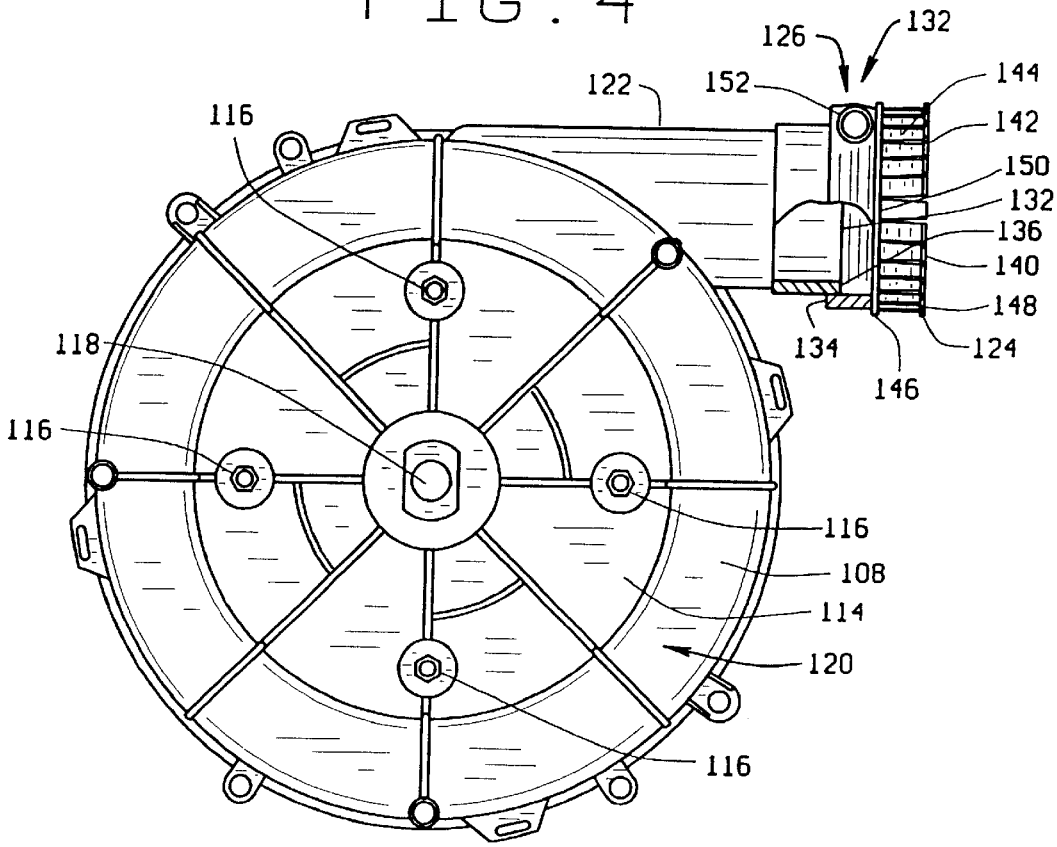
FIG. 5 is a top plan view of a blower housing of the blower of FIG. 3 with a partial, sectional view of an exhaust flange.

FIGS. 4 and 5 provide greater detail of the blower housing 104. The top piece 108 has an annular recessed area 114 adapted to hold the blower motor 102. The top piece 108 has mounting screws 116 for securely fastening the motor 102 to the blower housing 104 and a through hole 118 to allow a shaft on the blower motor 102 to pass into the housing 104. The blower motor shaft (not shown) is operably connected to an impeller (not shown) rotatably disposed within the blower housing 104. The upstanding annular wall 106, and top and bottom pieces 108,110 form a volute 120. The blower housing 104 also includes a discharge pipe 122 for directing exhaust gases pressurized in the volute 120 out of the blower housing 104. An outermost end 124 of the discharge pipe 122 has an exhaust flange 126 that allows the blower 100 to be connected to the exhaust pipe 42.

The Figures show a blower housing 104 having a top piece 108 with the discharge pipe 122, an upstanding wall 106, and exhaust flange 126, and a relatively flat, separate bottom piece 110. It is also possible to construct the bottom piece with the upstanding annular wall, discharge pipe, and exhaust flange and a separate top piece that attaches to the bottom piece to enclose the blower housing. The bottom piece may also have the upstanding wall, discharge pipe, and exhaust flange constructed monolithically. The bottom piece may also be made from a polypropylene material.

FIG. 4 shows an exhaust fitting 128 of the present invention installed in the exhaust flange 126 to form an exhaust interface 130 for the blower 100 and the exhaust pipe 42. The exhaust flange 126 is formed on the outermost end 124 of the discharge pipe 122 and has an outer cylinder portion 132 extending around the discharge pipe 122. The outer cylinder portion 132 has a rear annular wall 134 that connects the outer cylinder portion 132 to the discharge pipe 122 and forms an internal shoulder 136 inside the outer cylinder portion 132 for the exhaust fitting 128 to rest against when the exhaust fitting 128 is installed in the exhaust flange 126. The rear annular wall 134 and internal shoulder 136 are shown in the partial sectional view in FIG. 5. The outer cylinder portion 132 has an inner diameter that is preferably larger than the bore of the discharge pipe 122. This arrangement prevents a restriction in the discharge path of the exhaust gases when the exhaust fitting 128 is installed in the exhaust flange 126. The rear annular wall 134 and outer cylinder portion 132 define an annular socket 138 on the end of the discharge pipe 122. The annular socket 138 has an interior that is sized to receive the exhaust fitting 128 and prevent the exhaust fitting 128 from twisting out of the annular socket 138.

As shown in FIGS. 4 and 5, the outer cylinder portion 132 of the exhaust flange 126 has an annular ridge 140, and a plurality of axial slots 142 extending inwardly from the outermost edge 124 of the outer cylinder portion 132. The slots 142 are circumferentially spaced around the annular socket 138 and form a plurality of resilient teeth 144. Each of the teeth 144 has a proximal end 146 and distal end 148. The proximal end 146 is cantileverly attached to the outer cylinder portion 132 so that the tooth 144 may flex radially inward into the annular socket 138. The distal end of each tooth 148 includes a portion of the annular ridge 140 formed on the outermost edge 124 of the outer cylinder portion 132.

To allow the teeth 144 to compress radially inward, the outermost edge of each of the slots 142 is wider than the portion of the slot 142 near the proximal edge of each tooth 144. To provide a keying alignment between the exhaust flange 126 and the exhaust fitting 128, a slot in the outer cylinder portion 132 is preferably widened to function as a key slot 150.

Positioned between the outermost edge 124 of the outer cylinder portion 132 and the rear annual wall 134 is a drain 152. The drain 152 extends outward and away from the outer cylinder portion 132 and communicates with the annular socket 138. Preferably, the drain 152, the outer cylinder portion 132 and the discharge pipe 122 are monolithically formed.

Figure 6:
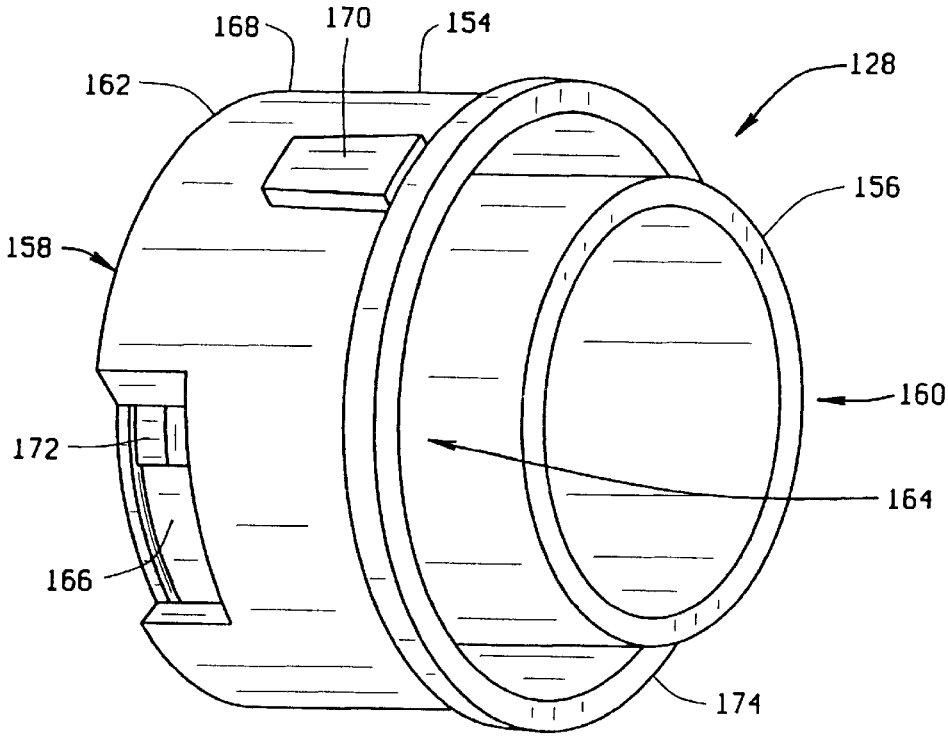
FIG. 6 is a rear, perspective view of the exhaust fitting of FIG. 4.
Figure 7:
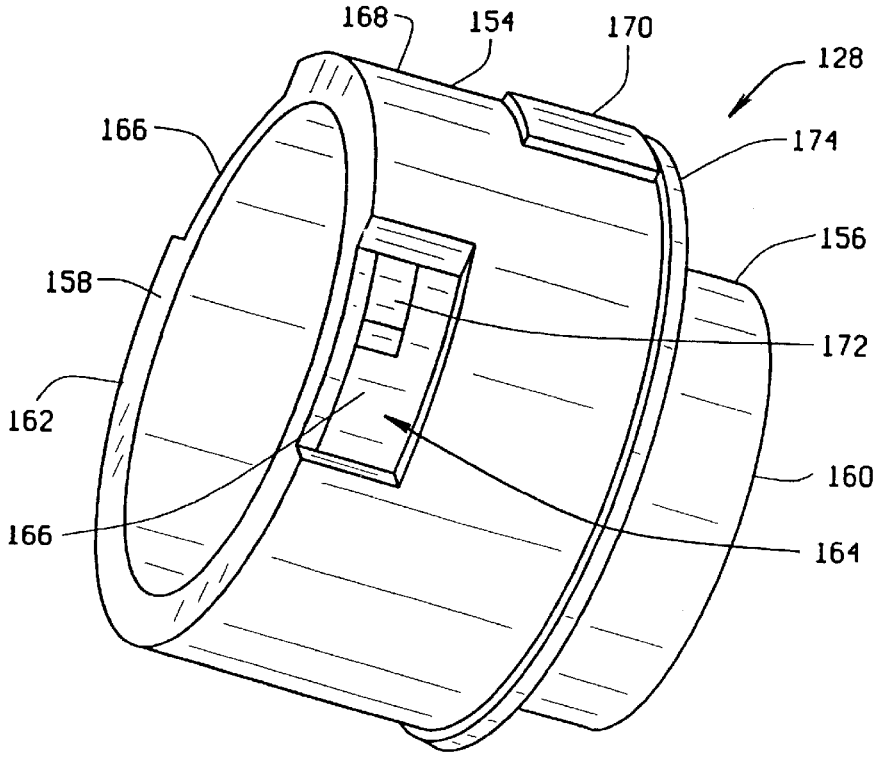
FIG. 7 is a front, perspective view of an exhaust fitting of FIG. 4.

FIGS. 6 and 7 show the preferred embodiment of the exhaust fitting 128. The exhaust fitting 128 has a first tube portion 154 and a second tube portion 156 with each tube portion 154,156 having first and second ends 158,160 and an annular side wall 162 extending between the first and second tube portions 154,156 at the first end 158. Preferably, the second tube portion 156 is positioned concentrically within the first tube portion 154. The arrangement of the first and second tube portions 154,156 and the annular side wall 162 create an annular groove 164 in the second end 160 of the exhaust fitting 128. Preferably, the second tube portion 156 is axially longer than the first tube portion 154 such that the second tube portion 156 extends through the second end 160 of the first tube portion 154.

The first tube portion 154 preferably has a circumferential slot 166 which is relieved through the annular side wall 162. The slot 166 communicates with the annular groove 164, and when the exhaust fitting 128 is installed in the exhaust flange 126, the slot 166 ultimately communicates with the drain 152. The first tube portion 154 has an outer surface 168 and a key 170 extending outward from the outer surface 168 that is received in the key slot 150 on the exhaust flange 126 when the exhaust fitting 128 is installed in the exhaust flange 126. The key arrangement between the exhaust flange 126 and the exhaust fitting 128 ensures alignment and communication between the slot 166 and the drain 152 to ensure the removal of condensate entrained in the exhaust gas. Preferably, a plurality of stops 172 are circumferentialy spaced around the inside of the annular groove 164. The stops 172 are arranged in the annular groove 164 to permit communication around the groove 164 and into the slot 166 and drain 152. The stops 172 hold the end of the exhaust pipe 42 off the bottom of the annular groove 164, when the exhaust pipe 42 is installed in the exhaust fitting 128. This arrangement permits condensate forming in the exhaust pipe to collect in the annular groove 164, flow to the slot 166, and out of the exhaust system via the drain 152.

The first tube portion 154 preferably has a circumferential lip 174 extending radially outward on its outer surface 168 on the first end 158. The lip 174 functions as a positive stop to abut the circumferential ridge 140 on the outer cylinder portion 132 of the exhaust flange 126 when the exhaust fitting 128 is installed in the exhaust flange 126. The outer surface 168 of the first tube portion 158 is sized to be slidingly received in the annular socket 138 of the exhaust flange 126. When the exhaust fitting 128 is installed in the exhaust flange 126, the annular side wall 162 of the exhaust fitting 128 preferably abuts the internal shoulder 136 in the annular socket 138 of the exhaust flange 126. The depth of the annular socket 138 provides proper support for the exhaust fitting 128.

During installation of the blower 100 in the furnace 101 and connection of the blower 100 to the exhaust pipe 42, the blower 100 may be attached to the blower mounting surface 112 and the exhaust fitting 128 may be inserted into the exhaust flange 126. Preferably, the exhaust fitting 128 is assembled with the exhaust flange 126 in only one orientation using the key 170 and key slot 150 arrangement on the exhaust interface 130. Once the exhaust fitting 128 is inserted in the exhaust flange 126, the exhaust pipe 42 may be inserted into the annular groove 164 such that the exhaust pipe 42 rests upon the stops 172 inside the annular groove 164. A clamping means 176, such as band clamp or common hose clamp, may be installed around the circumferentialy spaced teeth 144 on the outer cylinder portion 132. The clamping means 176 may then be tightened, radially deflecting the teeth 144 inward to compress the teeth 144 against the outer surface 168 of the first tube portion 154 and the exhaust pipe 42.

Because the exhaust fitting 128 is preferably made from a rubber material, the pressure exerted from the teeth 144 may be transmitted directly to the exhaust pipe 42 to ensure a tight fit. The size and length of the annular socket 138 and the annular groove 164 allow the exhaust interface 130 to meet the industry standards for torque and parallel force failure.

In operation, condensate entrained in the exhaust gases is collected in the annular groove 164 provided in the exhaust fitting 128 and is directed to the slot 166 where it is removed to the appropriate collection facility in the furnace 101.

As will be appreciated by those skilled in the art, the exhaust interface 130 of the present invention is less complex than the prior art and uses less parts, thus decreasing the cost of the blower 100. The exhaust flange may be formed with a die insert that is installed in the mold when forming the conventional blower.

Although a band clamp is shown as the clamping means 176 to radially compress the teeth 144 inward to secure the exhaust pipe 42 in the exhaust fitting 128 and the exhaust fitting 128 in the exhaust flange 126, other clamping means may be used. The clamping means may include a ring which is threadably attached to the outer cylinder portion of the discharge pipe. The ring may be rotated and tightened so as to compress the teeth radially inward. The clamping means may also include a hose clamp or other strap clamp which is tightened by tangential force exerted on the strap.

As various changes could be made in the above construction without departing from the scope of the invention, it is intended that all matter contained in the above description and shown in the accompanying drawings shall be interpreted as illustrative and not in any limiting sense. The invention therefore shall be solely limited by the scope of the claims set forth below.

What is claimed is:

1. A blower for a furnace comprising a blower housing having an exhaust flange, said exhaust flange having a compressible end portion, and a flexible fitting inserted within said flange and adapted to receive an exhaust pipe that receives and evacuates gases from within said blower, and a clamp for compressing the compressible end portion about the flexible fitting and the exhaust pipe to thereby secure the exhaust pipe to the blower wherein said compressible end portion further comprises a plurality of teeth formed in said end portion and about the periphery thereof;

each of said teeth has a ridge formed substantially at its end, said ridge comprising an upstanding portion extending radially outward therefrom;

each of said exhaust flange and exhaust fitting have a guttering system for collecting condensate within the exhaust pipe, exhaust flange, and exhaust fitting and directing it out of said blower and exhaust pipe; and a key formed in one of said exhaust flange and exhaust fitting and a slot formed in the other of said exhaust flange and exhaust fitting to thereby restrict the assembly thereof to a given orientation and place the guttering system of each in communication; and said fitting further comprises a stop for positioning the exhaust pipe within the fitting.

2. The blower housing of claim 1 wherein the exhaust fitting has a circumferential lip on its outer surface that abuts the ridge on each of the exhaust flange teeth when the fitting is installed in the flange.

3. The blower housing of claim 1 wherein said slot is formed on said exhaust flange between two adjacent teeth.

4. The blower housing of claim 1 wherein said fitting has a groove on one of its side faces to receive the exhaust pipe and the stop is formed in a base of the groove thereby positioning a butt end of the exhaust pipe in a spaced apart relationship from the groove base.

5. The blower housing of claim 1 wherein said exhaust flange and blower housing, are monolithically formed.

6. The blower of claim 1 wherein said fitting includes a cylindrical portion for extending into the exhaust pipe as it is assembled to the blower.

7. The blower of claim 6 further comprising a motor secured to an impeller within the blower.

8. The blower housing of claim 6 wherein the exhaust fitting cylindrical portion has an inner surface for containing the gases as the gases pass from the exhaust flange to the exhaust pipe, said cylindrical portion inner surface provides a substantially uniform transition from the exhaust flange to the exhaust pipe.

9. An exhaust fitting for connecting an exhaust pipe to a discharge pipe of a blower housing for a furnace wherein the blower housing discharge pipe extends outward from the housing and directs exhaust gases from an interior of the blower housing to the exhaust pipe, the discharge pipe has a distal end and flexible teeth circumferentially spaced around the distal end, the exhaust fitting comprising:

a tube shaped member having a generally cylindrical exterior surface dimensioned to be received in an interior of the discharge pipe and a generally cylindrical interior surface for containing the exhaust gases when the tube shaped member is inserted in the discharge pipe, the tube shaped member having a groove on one of its end faces between the cylindrical exterior and interior surfaces dimensioned to receive the exhaust pipe, the tube shape member being made of a resilient material such that when the exhaust pipe is inserted in the tube member groove and the tube shaped member is inserted in the discharge pipe, compression of the discharge pipe circumferential teeth against the exhaust fitting cylindrical exterior surface secures the exhaust pipe in the groove.

10. The exhaust fitting of claim 9 further comprising at least one circumferential slot through the tube shaped member exterior surface into the groove and a keyed relationship between the exhaust fitting and the discharge pipe that allows the tube member circumferential slot to be aligned with a drain port provided on the discharge pipe when the exhaust fitting is installed in the discharge pipe distal end.

11. The exhaust fitting of claim 10 further comprising at least one stop formed in a base of the tube shaped member groove to hold a butt end of the exhaust pipe in a spaced apart relationship from the groove base when the exhaust pipe is installed in the groove.

12. The exhaust fitting of claim 10, wherein the tube shaped member cylindrical exterior surface has a circumferential lip that engages the discharge pipe distal end when the exhaust fitting is installed is installed in the discharge pipe distal end.

13. A discharge pipe for a blower housing for a furnace, the discharge pipe extending out from the blower housing to direct exhaust gases away from the blower housing, the discharge pipe having a center axis extending along its length, the discharge pipe comprising:

a distal end of the discharge pipe with a plurality of axial slots and teeth on the discharge pipe distal end circumferentially spaced about the distal end;

a drain formed on the discharge pipe distal end; and an exhaust fitting insertable into the discharge pipe distal end, the exhaust fitting having an outer tube portion and a inner tube portion concentrically disposed within the outer tube portion with a rear annular wall extending between the outer and inner tube portions thereby forming an annular groove within the exhaust fitting to receive the exhaust pipe when the exhaust pipe is installed in the exhaust fitting, the groove having a drain hole that communicates with the discharge pipe drain when the exhaust fitting is installed in the discharge pipe distal end.

14. The discharge pipe of claim 13 further comprising a clamping device for securing the exhaust fitting in the exhaust flange, the clamping device being positionable over the teeth to compress the teeth radially inward against the outer tube portion and against the exhaust pipe when the exhaust fitting is installed in the discharge pipe distal end and the exhaust pipe is installed in the exhaust fitting groove.

15. The discharge pipe of claim 13 wherein the discharge pipe distal end has an interior shoulder extending radially from an interior surface of the discharge pipe and the exhaust fitting rear annular wall engages against the interior shoulder when the exhaust fitting is inserted in the discharge pipe.

16. The discharge pipe of claim 13 wherein the exhaust fitting has a circumferential lip on an exterior surface of the outer tube portion opposite the rear annular wall and the circumferential lip engages with the discharge pipe distal end when the exhaust fitting is inserted in the discharge pipe.

17. The discharge pipe of claim 13 further comprising a key formed in one of the discharge pipe distal end and the exhaust fitting and a slot formed in the other of the discharge pipe distal end and exhaust fitting to thereby restrict the assembly thereof to a given orientation thereby aligning the discharge pipe drain and exhaust fitting drain hole.

* * * * *